United States Patent [19]

Desjoyaux et al.

[11] Patent Number: 4,801,378

[45] Date of Patent: Jan. 31, 1989

[54] COMPACT UNIT FOR SERVICING SWIMMING POOLS

[76] Inventors: Pierre Desjoyaux; Jean-Louis Desjoyaux, both of RN 82,, 42480 La Fouillouse, France

[21] Appl. No.: 669,313

[22] Filed: Nov. 7, 1984

[30] Foreign Application Priority Data

Nov. 10, 1983 [FR] France ..... 83 18248

[51] Int. Cl.[4] ..... E04H 3/16

[52] U.S. Cl. ..... 210/169; 210/416.2; 4/489; 4/493; 4/507; 4/509

[58] Field of Search ..... 210/169, 416.2; 4/489, 4/493, 507, 509, 511, 512

[56] References Cited

U.S. PATENT DOCUMENTS

| | | | |
|---|---|---|---|
| 3,616,918 | 11/1971 | Diemond | 210/169 |
| 3,820,173 | 6/1974 | Weller | 210/169 |
| 4,126,925 | 11/1978 | Jacuzzi | 210/169 |
| 4,193,143 | 3/1980 | De Carvalho Vianna | 210/169 |
| 4,325,462 | 4/1982 | Gouzous | 210/169 |
| 4,421,643 | 12/1983 | Frederick | 210/169 |
| 4,426,286 | 1/1984 | Puckett et al. | 210/169 |

*Primary Examiner*—Asok Pal
*Assistant Examiner*—Sharon T. Cohen
*Attorney, Agent, or Firm*—Remy J. VanOphem

[57] ABSTRACT

A compact portable unit for servicing and treating the water of a swimming pool. The unit has a front section and a rear section connected together by an upper section to form a saddle which is set over a side wall of the swimming pool. The front section is submerged in the water contained by the pool and contains a skimmer, a scummer, a filter, and a recycling outlet. The front section may also be provided with footholds, lights, and handrails. The rear section contains a pump and electrical apparatus for operation of the unit. The unit may be equipped with a water heater and is readily installed and removed.

9 Claims, 1 Drawing Sheet

COMPACT UNIT FOR SERVICING SWIMMING POOLS

BACKGROUND OF THE INVENTION

1. Field of the Invention

The invention relates to a filtration and servicing unit for a swimming pool. More particularly, this invention relates to a self-contained and portable unit which has all the working characteristics of a permanently installed filtration system.

2. Description of the Prior Art

Permanently installed filtration units for swimming pools which include "skimmers," that is to say articulated shutters allowing the intake of water from the surface, are known. These shutters are incorporated in the masonry and are connected by pipes of adequate size to a suitable motor-pump group and filters. Other pipes provide for the return of filtered water to the swimming pool.

A permanently installed system, as described above, is expensive because it requires a long run of piping and adaptation to the main installation of the swimming pool. Because of the long run of piping, losses in pressure occur which are costly in energy. The long run of piping also presents a risk of breakage in the case where winterization has not been properly undertaken. Finally, these systems are not compatible with swimming pools which are prefabricated from conventional materials.

Single unit filtration systems having a filter and a motor-pump group are also known in the art. These systems consist of an entry pipe and an exit pipe submerged in the water of the swimming pool. These single unit filtration systems are unaesthetic and do not permit a skimming of the water, where foreign objects such as leaves that are found on the surface are to be removed. In general, these systems are designed in such a way to insure at least a partial filtration of the water. Other devices must be incorporated in the swimming pool for entering and leaving the pool, and for lighting the water. These various devices are incorporated in the masonry of the pool, when the swimming pool is of the conventional type. However, it is more difficult to incorporate these devices in a swimming pool that has been prefabricated.

SUMMARY OF THE INVENTION

This invention relates to a portable, compact filtration and servicing unit for a swimming pool. This unit is adapted to rest on the edge of the swimming pool in such a way to fulfill the necessary pool maintenance function, and thereby overcomes the problems associated with prior art pool filtration systems, as described above.

Accordingly, it is the primary object of the invention to provide a compact unit drawing in and filtering polluted water from a swimming pool, and for filtering water back to the pool.

It is another object of the invention to provide a swimming pool water treatment device which is capable of chemically treating the water.

Another object of the invention is to provide a compact swimming pool water treatment unit which incorporates elements for heating the water.

Another object of the invention is to provide a compact swimming pool water treatment unit in the shape of a saddle, thereby allowing it to be put astride the edge of the swimming pool without any special preparation, in such a way that a part of the unit rests against the wall of the pool and is submerged.

It is another object of the invention to provide a swimming pool water treatment unit that is partially submerged in the pool and which has openings on the opposite sides of the submerged section, with one of the openings being used to draw water from the pool into the unit and the other of the openings being used to return water from the unit to the pool.

It is another object of the invention to provide a swimming pool water treatment unit with an intake hole which is equipped with a "skimmer" in the form of a shutter revolving around a horizontal axis.

It is another object of the invention to provide a swimming pool water treatment unit with a perforated float, called a scummer, located behind the intake hole to provide for the recovery of solid debris suspended in the water to be filtered.

It is another object of the invention to provide a swimming pool water treatment unit which has a filter located in a vertical position under the scummer, so that the water flowing through it can pass through the filter from the outside towards the inside as a result of the force of gravity.

It is a further object of the invention to provide a swimming pool water treatment unit which has a submerged section with footholds or rungs on the front side of the submerged section, to be used as a ladder.

It is a further object of the invention to provide a swimming pool water treatment unit which is in the shape of a saddle and which has a submerged section that has footholds in the submerged section that serve as a ladder, in which the water treatment unit has one or more handrails which are located along the side of the ladder and which extend to the upper section of the saddle. The handrails may be used for climbing the ladder and for lifting the unit out of the swimming pool.

These and other objects, features, and advantages of the present invention will become apparent to those skilled in the art upon reading the following detailed description in conjunction with the drawing appended hereto.

DETAILED DESCRIPTION OF THE PREFERRED EMBODIMENT

Figure 1:
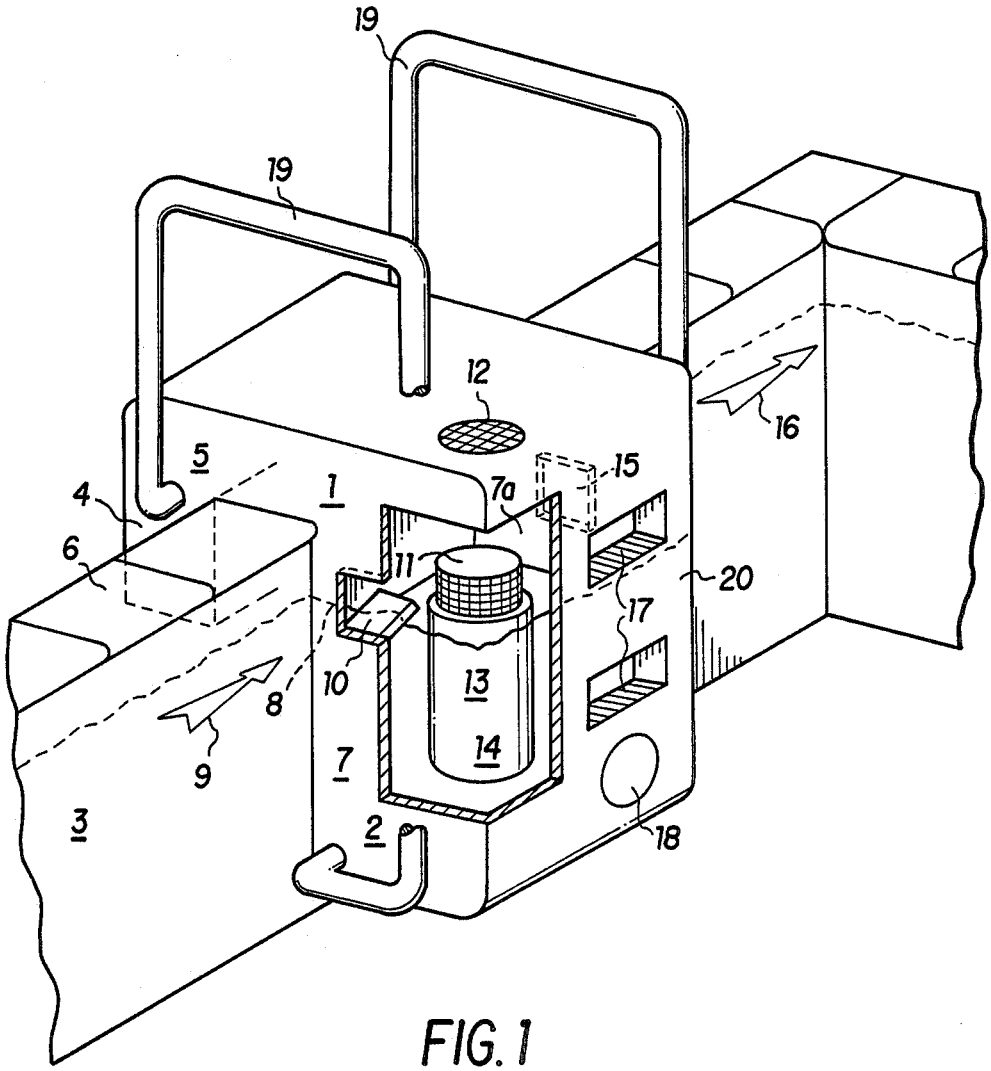
FIG. 1 is a perspective view of a compact swimming pool filtration unit according to the invention.

The compact swimming pool water treatment unit 1 has a front section 2 which is submerged below the surface of the pool water along a vertical wall 3 of a swimming pool 6. The compact swimming pool water treatment unit also has a rear section 4 and an upper section 5 connecting the front section 2 to the rear section 4 to sit over the edge of the vertical wall 3 of the pool 6 like a saddle.

The front section 2 which is submerged has a pair of side faces 7 and **7*a* and a front face 20. On face 7 is an intake hole 8 permitting the entry of water contained in the swimming pool in the direction of the arrow 9. The intake hole 8 has a "skimmer" 10, or a shutter pivoting inward to admit water to the interior of the swimming pool water treatment unit 1. Behind the intake hole 8 of the front section 2 is positioned a scummer 11 or perforated float as is known to one skilled in the art. The scummer 11 provides for the recovery of solid debris contained in the water. The scummer 11 may also be adapted to hold the chemical crystals necessary for treating the water in the swimming pool. An openng 12 situated in the upper section 5 of the compact swimming pool water treatment unit 1 allows the removal of the scummer 11** for cleaning purposes.

In the preferred embodiment, a pre-filtration element 13 and filtration block 14 are placed under the scummer 11 in vertical alignment with the vertical axis of the scummer 11. Pipes, not shown, in order to make the drawing more clear, conduct the water coming out of the filtration block 14 to an auto-operated pump, not shown, situated in the rear section 4 of the compact swimming pool water treatment unit. The necessary electrical elements for the swimming pool water treatment unit 1 are not shown, but are positioned in the rear section 4 of the swimming pool water treatment unit 1. A water heater, also not shown, may also be positioned in the rear section 4 to heat the filtered water. Finally, another pipe, not shown, returns the filtered water from the swimming pool water treatment unit 1 through outlet 15, preferably situated in relation to the intake hole 8 in the direction indicated by the arrow 16, thereby causing circulation of the water in the swimming pool in the direction indicated by arrows 9 and 16.

Positioned on the front face 20 of the front section 2 of the swimming pool water treatment unit 1 are footholds 17, preferably hollow, and a light 18. Handrails 19 are placed on either side of the front section 2. The handrails 19 extend above the upper section 5. One can readily understand these and many other advantages of the compact swimming pool water treatment unit 1.

The compact swimming pool water treatment unit 1 provides all the functions necessary for servicing the water of a swimming pool. While being portable, the compact unit can be placed in service by being simply placed over the edge of a swimming pool. The installation is instantaneous, since it is only necessary to plug in an electric cable. No construction of a servicing station is necessary, and no pipes or electrical cables have to be buried. The risk of leaks or freezing are eliminated and the swimming pool can retain water during winter. This system can be installed on all swimming pools, and it is particularly suited for prefabricated swimming pools because the compact swimming pool water treatment unit utilizes less pipe than other systems, which permits a considerable reduction in the pressure drop in the system, thereby resulting in the use of less power. The arrangement of the intake and outlet holes results in a circulation of the water in the pool. Further, the compact swimming pool water treatment unit is less expensive than non-portable systems, especially for use with prefabricated swimming pools.

Having thus described the present invention by way of an exemplary embodiment, it will be apparent to those skilled in the art that many modifications may be made from the exemplary embodiment without departing from the spirit of the present invention or the scope of the claims appended thereto.

What is claimed is:

1. A portable unit for servicing liquid present in a swimming pool having a wall, said wall having an external side and an internal side, said portable unit comprising:

a housing having a front section, a rear section, and an upper section extending from said front section to said rear section, said housing having the general form of an inverted U, said front section having a first side wall, a second side wall and a front wall extending therebetween, said first side wall and said second side wall extending in a direction perpendicular to said internal side of said wall of said swimming pool, said front section further being adapted to extend from said upper section downwardly along said internal side of said wall of said swimming pool such that said front section is adapted to extend beneath the surface of said liquid when said pool contains a predetermined amount of said liquid, said rear section being adapted to extend downwardly from said upper section along said external side of said wall of said swimming pool;

means for filtering said liquid from said swimming pool, said means for filtering positioned in said front section of said housing;

means for intaking liquid into said portable unit from said swimming pool, said means for intaking being positioned in said front section of said housng and comprising an inlet member positioned in said first side wall for delivering liquid to said means for filtering when said liquid in said swimming pool reaches a predetermined level;

outlet means positioned in said front section of said housing for returning filtered liquid to said swimming pool, said outlet means being positioned on said second side wall of said front section of said housing; and means for conveying liquid from said means for filtering to said outlet means, said means for conveying having a pump member positioned in said rear section of said housing, whereby filtered liquid is directed outward from said second side wall of said front section and generally parallel to the direction of the flow of liquid into said portable unit through said means for intaking liquid and generally parallel to said wall of said swimming pool to create a circulatory flow of liquid in said swimming pool from said outlet means to said inlet member.

2. A portable unit as claimed in claim 1 wherein said means for intaking liquid comprises a skimmer member pivotally mounted to said front section, said skimmer member pivoting inwardly about a horizontal axis to admit liquid into said front section for treatment.

3. A portable unit as claimed in claim 1 wherein means for filtering comprises a float member positioned in said front section, said float member having a plurality of holes for straining liquid as liquid passes through said plurality of holes; and a filter member connected to said float member to receive liquid passed through said plurality of holes.

4. A portable unit as claimed in claim 3 wherein said float member and said filter member are positioned in vertical alignment in said front section.

5. A portable unit as claimed in clam 1 wherein said portable unit further comprises, a heater member positioned in said rear section and interconnected with said meas for conveying liquid, said heater member selectively operable to heat liquid as it passes through said portable unit.

6. A portable unit as claimed in claim 1 wherein said portable unit further comprises, at least one step member positioned on said front section for use in entering and exiting said swimming pool.

7. A portable unit as claimed in claim 1 wherein said portable unit further comprises, at least one light member positioned on said front section of said portable unit to illuminate liquid in said swimming pool.

8. A portable unit as claimed in claim 1 wherein said portable unit further comprises at least one handrail member affixed to said housing.

9. A portable unit as claimed in claim 1 wherein said housing has an opening positioned for access to said float member.

* * * * *